United States Patent [19]

Sakaida et al.

[11] Patent Number: 4,723,854

[45] Date of Patent: Feb. 9, 1988

[54] DOT-MATRIX PRINT HEAD AND APPARATUS FOR SUPPORTING PIVOTABLE ARMATURES

[75] Inventors: Atsuo Sakaida, Gifu; Takamitsu Kawai, Ohbu, both of Japan

[73] Assignee: Brother Kogyo Kabushiki Kaisha, Aichi, Japan

[21] Appl. No.: 856,751

[22] Filed: Apr. 28, 1986

[30] Foreign Application Priority Data

May 1, 1985 [JP] Japan ..... 60-66254[U]
Jul. 19, 1985 [JP] Japan ..... 60-111446[U]

[51] Int. Cl.[4] ..... B41J 3/12
[52] U.S. Cl. ..... 400/124; 101/93.05
[58] Field of Search ..... 400/124; 101/93.05

[56] References Cited

U.S. PATENT DOCUMENTS

| | | | |
|---|---|---|---|
| 4,051,941 | 10/1977 | Hebert | 400/124 |
| 4,165,940 | 8/1979 | Cacciola | 400/124 |
| 4,167,343 | 9/1979 | Golobay | 400/124 |
| 4,222,674 | 9/1980 | Mori et al. | 400/124 |
| 4,244,658 | 1/1981 | Mori | 400/124 |
| 4,260,270 | 4/1981 | Cavallari | 400/124 |
| 4,349,283 | 9/1982 | Sapitowicz et al. | 400/124 |
| 4,367,962 | 1/1983 | Gaboardi | 400/124 |
| 4,375,338 | 5/1983 | Mitsuishi | 400/124 |
| 4,382,701 | 5/1983 | Davenport | 400/124 |
| 4,437,775 | 3/1984 | Ochiai et al. | 400/124 |
| 4,447,166 | 5/1984 | Ochiai et al. | 400/124 |
| 4,478,528 | 10/1984 | Hebert | 400/124 |
| 4,502,799 | 3/1985 | Weeks et al. | 400/124 |
| 4,513,496 | 4/1985 | Wang | 400/124 |
| 4,518,269 | 5/1985 | Akazawa | 400/124 |
| 4,552,064 | 11/1985 | Sanders, Jr. et al. | 400/124 |
| 4,576,491 | 3/1986 | Mishio | 400/124 |
| 4,653,943 | 3/1987 | Sakaida et al. | 400/124 |

FOREIGN PATENT DOCUMENTS

| | | | |
|---|---|---|---|
| 98366 | 6/1982 | Japan | 400/124 |
| 187268 | 11/1982 | Japan | 400/124 |
| 222860 | 12/1983 | Japan | 400/124 |
| 85773 | 5/1984 | Japan | 400/124 |
| 152869 | 8/1984 | Japan | 400/124 |
| 156761 | 9/1984 | Japan | 400/124 |
| 107359 | 6/1985 | Japan | 400/124 |
| 2030502 | 4/1980 | United Kingdom | 400/124 |

OTHER PUBLICATIONS

R. H. Harris, "Unitary Molded Wire Guide and Back Cover"; *IBM Technical Disclosure Bulletin*; vol. 27, No. 7B, pp. 4245–4246; Dec. 1984.

*Primary Examiner*—Edgar S. Burr
*Assistant Examiner*—David A. Wiecking
*Attorney, Agent, or Firm*—Parkhurst & Oliff

[57] ABSTRACT

A dot-matrix print head including a plurality of armatures, each of which is connected at its distal end to a print wire and has at its proximal end a pair of lateral extensions which extend in lateral opposite directions from the proximal end. The print head includes a supporting device for supporting the armatures and the print wires such that the armatures are pivotable at the proximal ends to move the print wires endwise. The supporting device has a pair of first protrusions engaging a pair of lateral surfaces of the lateral extensions of each armature which face toward the distal end. The supporting device further has a second protrusion disposed between the first protrusions as seen in the lateral direction of the armature, the second support protrusion engaging an end surface of the proximal end of each armature. The first and second protrusions permit each armature to be pivoted about the proximal end while preventing the armature from being moved in its longitudinal direction. The armatures are driven by a drive which includes electromagnets corresponding to the armatures, so that the armatures are pivoted about their proximal ends, upon energization and deenergization of the electromagnets, thereby giving the print wires longitudinal movements for dot-matrix printing. The supporting device is located radially within the electromagnetic yoke.

15 Claims, 6 Drawing Figures

DOT-MATRIX PRINT HEAD AND APPARATUS FOR SUPPORTING PIVOTABLE ARMATURES

BACKGROUND OF THE INVENTION

The present invention relates in general to a dot-matrix print head, and more particularly to a structure for pivotal movements of armatures for longitudinal or endwise movements of print wires.

In a known dot-matrix print head, each of a plurality of armatures supporting respective print wires is pivotally supported for endwise movements of the print wires, upon energization and deenergization of respective electromagnets which are accommodated in a cylindrical yoke in circumferentially spaced-apart relation with each other. The armatures are disposed radially such that the distal end of each armature to which the print wire is secured is disposed in the central part of the cylindrical yoke. In such type of dot-matrix print head, a structure for pivotal support of each armature includes a support pin erected on or near the cylindrical wall of the yoke. Each armature has a hole in which the corresponding pin is loosely fitted, so that the armature is pivotable about the pin or hole, in a plane parallel to the pin (in a plane perpendicular to the plane of the armature), when the corresponding electromagnet is energized to magnetically attract the armature. In this arrangement, the print wires connected to the distal ends of the armatures are selectively activated through selective energization of the corresponding electromagnets according to printing data, whereby desired images such as characters may be printed in a matrix of dots formed by the free ends of the activated print wires.

The print wires are returned to their non-operated positions upon deenergization of the corresponding electromagnets, with biasing forces of biasing springs acting on the corresponding armatures. The print wires are held in their non-operated positions by the biasing springs.

In the case where the support pins for the armatures are fixed in holes formed in the cylindrical wall of the yoke, the wall should be formed with a large enough thickness to form the holes for the support pins. This results in an increase in the size and weight of the print head. In the case where the support pins are fixed in holes radially inwardly away from the cylindrical wall of the yoke, there exists a large distance between the support pins and the cylindrical wall of the yoke at which the armatures are pivotally supported. The distance between a hole to be formed in each armature for the support pin and the proximal end face of the armature must be large enough to maintain a sufficient strength of the armature at its proximal end portion during formation or cutting of the hole in order to permit the hole to be properly formed. Otherwise, the proximal end portion of the armature may be deformed due to a force exerted during the formation of the hole. Further, the support pin must have a sufficient diameter to provide a sufficient mechanical strength, and consequently the pin hole in the armature must have a correspondingly large diameter. For the reasons stated above, the pin-and-hole arrangement for the armature requires a relatively large distance between the support pin (point of contact of the armature with the pin) and the cylindrical wall of the yoke at which the armature is pivotally supported. Therefore, the pivotal movements of the armature about its proximal end will cause a relatively large amount of relative movements between the armature and the support pin engaging the pin hole, whereby the armature and the support pin are subject to large amounts of friction and wear. A frictional resistance to the movements of the armature relative to the support pin will cause a variation in the operating force of the armature. Further, the wear of the armature and the support pin will cause a variation in the position of the distal end of the armature at which the print wire is fixed. Accordingly, the operating stroke of the print wire is varied, resulting in a variation of the printing force of the print wire against a recording medium. Thus, the dot-matrix print head using the pin-and-hole support structure for the armatures suffers from inconsistent or unstable quality of printing by the print wires, due to a large distance of the support pin from the proximal end of the armature at which the armature is pivotally supported.

Another factor for inconsistency of the printing forces of the print wires lies in that the print wires are held in their non-operated positions with different values of forces acting on the armatures, even though the biasing springs for returning the print wires to their non-operated positions have the same free length and the same spring constant. Namely, a force which must be overcome by a magnetic force produced by an electromagnet for one armature is different from that which must be overcome by a magnetic force produced by an electromagnet for another armature. This difference is caused by a difference in the amount of deflection of the print wires from one wire to another. More specifically, the fixed ends of the print wires secured to the distal ends of the armatures are arranged along a circle, while the free ends of the armatures are generally arranged in one or two straight rows. Therefore, the print wires are elastically deformed in different degrees between their fixed and free ends. While the biasing springs primarily serve to hold the armatures in their non-operated positions, the print wires function more or less to apply biasing forces to the armatures, due to their elastic deformation. The biasing forces of the print wires which are produced due to their elastic deformation are different from each other because the amounts of deflection of the print wires are different from each other. For this reason, the armatures receive different total values of biasing forces.

SUMMARY OF THE INVENTION

It is accordingly an object of the present invention to provide a compact dot-matrix print head having a structure for pivotal support of armatures at their proximal ends, which structure assures consistent operating forces and strokes of print wires, and thereby permits improved printing quality.

Another object of the invention is the provision of such a dot-matrix print head wherein the armatures are held in their operated or non-operated positions away from iron cores of the corresponding electromagnets, with substantially the same forces, even though the amounts of deflection of the print wires between their fixed and free ends are different from each other.

According to the present invention, there is provided a dot-matrix print head, comprising: a plurality of print wires; a plurality of armatures corresponding to the plurality of print wires and disposed substantially perpendicularly to the print wires, each of the plurality of armatures having a distal end connected to the corresponding print wire, and a proximal end opposite to the distal end in a longitudinal direction thereof, the above-indicated each armature having a pair of lateral extensions which extend in lateral opposite directions from the proximal end; support means for supporting the plurality of armatures and the plurality of print wires such that the armatures are pivotable at the proximal ends thereof while the print wires are longitudinally movable, the support means including a pair of first support protrusions engaging a pair of lateral surfaces of the pair of lateral extensions of the above-indicated each armature, the lateral surfaces facing in the longitudinal direction toward the distal end, the support means further including a second support protrusion which is disposed between the pair of first support protrusions as seen in the lateral direction of the armature, the second support protrusion engaging an end surface of the proximal end of the above-indicated each armature, the pair of first support protrusions and the second support protrusion permitting the above-indicated each armature to be pivoted about the proximal end while preventing the above-indicated each armature from being moved in the longitudinal direction; and drive means, supported by the support means, for driving the plurality of armatures, the drive means including a plurality of electromagnets corresponding to the plurality of armatures, the electromagnets being energized and deenergized to pivot the armatures about the proximal ends in opposite directions, and to thereby give the print wires longitudinal movements for dot-matrix printing.

In the dot-matrix print head of the present invention constructed as described above, the armatures carrying the print wires at their distal ends are pivoted about their proximal ends, upon controlled energization and deenergization of the corresponding electromagnets, whereby the print wires are longitudinally moved for dot-matrix printing operations. Described more specifically, each armature is positioned at three points, by the two first support protrusions engaging the lateral surfaces of the lateral extensions formed at the proximal end of the armature, and the second support protrusion engaging the end surface of the proximal ends. The first and second support protrusions permit the armature to be pivoted about the proximal end, more precisely about a straight line defined by the edge of the proximal end, parallel to the lateral extensions. The first two support protrusions prevent the armature from moving toward the distal end, while the second support protrusion prevents the armature from moving toward the proximal end. The lateral surfaces engaging the first support protrusions are spaced from the proximal end surface by a distance equal to the thickness of the lateral extensions. It is noted that this thickness is equivalent to the distance of the conventional print head, between the proximal end face of the armature and a point on the circumference of the pin hole, which is nearest to the end face. Namely, the distance between the end face of the armature of the instant print head and the lateral surfaces is smaller, by a value equal to the diameter of the conventionally used pin hole, than the maximum distance between the proximal end face of the armature of the conventional print head and the innermost point of frictional contact of the pin with the armature. Accordingly, the frictional resistance and wear at the innermost point of contact of the armature with its support structure upon pivotal movements thereof are reduced. Hence, the operating forces and strokes of the print wires are made comparatively constant, resulting in improvement in the printing quality. In the instant print head, the wear of the armature at its proximal end portion engaging the support protrusions is held at a comparatively low level, since the area of contact of the first and second support protrusions with the lateral extensions and proximal end surface of the armature can be made larger than the area of contact of a support pin with a pin hole used in the conventional print head, without increasing the distance between the proximal end surface and the innermost point of contact of the armature with the support protrusions.

According to one advantageous feature of the invention, the proximal end of each armature has a cutout formed in the end surface of the proximal end toward the distal end, so that the second support protrusion is fitted in the cutout.

According to another advantageous feature of the invention, the support means comprises: a cylindrical yoke having a bottom wall at one of opposite longitudinal ends thereof, the bottom wall having a first central opening through which the print wires are passed, the cylindrical yoke accommodating iron cores of the electromagnets such that the iron cores are supported by the bottom wall in spaced-apart relation with each other in a circumferential direction of the yoke; first retainer means for supporting the plurality of armatures, the first retainer means including a generally disc-like portion which has a second central opening aligned with the first central opening of the cylindrical yoke so as to permit the print wires to extend therethrough, the plurality of armatures being disposed on the generally disc-like portion such that the armatures extend radially from the second central opening; and second retainer means disposed so as to cooperate with the first retainer means to sandwich the plurality of armatures, the second retainer means being fixed to the cylindrical yoke.

In one form of the above feature of the invention, the generally disc-like portion of the first retainer means has plural pairs of the first support protrusions corresponding to the armatures. The plural pairs of the first support protrusions are disposed in spaced-apart relation with each other along an outer circumferential part of the generally disc-like portion. The second retainer means has the second support protrusion for each of the plural pairs of the first support protrusions.

In another form of the above feature of the invention, the second retainer means includes a biasing member which acts on portions of the plurality of armatures adjacent to the proximal ends thereof, to bias the armatures against an end face of the cylindrical yoke at the other longitudinal end remote from the bottom wall.

In a further form of the same feature of the invention, the generally disc-like portion of the first retainer means has a pair of third support protrusions for each armature. The third support protrusions engage a pair of generally longitudinal surfaces of the armature adjacent to the distal end, so as to prevent the distal end of the armature from moving in the lateral direction while permitting the armature to be pivoted at the proximal end.

In a still further form of the same feature of the invention, the support means comprises a plurality of springs corresponding to the plurality of armatures. Each of the springs are disposed between a part of the each armature adjacent to the distal end, and a part of the generally disc-like portion of the first retainer means opposite to the part of the armature. Each of said springs holds the armature in an inoperative position thereof in which the distal end is spaced a predetermined distance away from the part of the generally disc-like portion. Biasing forces of the springs are determined so that a sum of the biasing force of the each spring, and a biasing force of the corresponding print wire which is developed due to elastic deformation thereof and which is applied to the corresponding armature in a direction toward a non-operated position thereof, is substantially the same for all of the plurality of armatures, though the print wires are elastically deformed in different degrees with their fixed ends arranged on a circle and their free ends arranged in at least one row on a straight line. The free ends of the print wires may be positioned in a single row on a straight line, or in two or more rows on two or more straight lines, or in three or more rows on three or more straight lines which define a polygon.

In the above form of the invention, the springs may be compression coil springs which have the same free length and the same spring constant. The coil springs are accommodated in respective holes formed in the generally disc-like portion of the first retainer means, such that one end of the spring bears on a bottom surface of the corresponding hole. The respective holes have different depths, so that the coil springs are given different values of biasing force.

In yet another form of the above feature of the invention, the first retainer means further includes a hollow nose portion which perpendicularly extends from one of opposite sides of said generally disc-like portion. The hollow nose portion communicates with the second central opening in the generally disc-like portion, and passes through the first central opening in the bottom wall of the cylindrical yoke, so that the plurality of print wires are longitudinally slidably guides in the hollow nose portion.

In a still further form of the same feature of the invention, the print head, further comprises elastic fastening means for fastening the second retainer means to the cylindrical yoke. The elastic fastening means includes a plurality of fixing legs engaging a plurality of first grooves and a plurality of second grooves. The first grooves are formed in an outer circumferential surface of the cylindrical yoke such that the first grooves are spaced from each other circumferentially of the cylindrical yoke and are parallel to a centerline of the cylindrical yoke. The second grooves are formed in an outer circumferential surface of the second retainer means such that the second grooves are aligned with the first grooves, respectively. The elastic fastening means further includes a plurality of spring portions which are held in elastically pressed contact with one of opposite surfaces of the second retainer means remote from the first retainer means, whereby the second retainer means is held pressed against an end face of the cylindrical yoke.

In the above form of the invention, the elastic fastening means may further comprise a central portion and a plurality of radial arms which extend radially from the central portion and terminate in proximal ends of the corresponding fixing legs. Each of the spring portions includes a sheet spring which comprises a pair of arcuate extensions which extend from the corresponding radial arm in opposite directions along a circumference of the second retainer means such that the arcuate extensions approach the above-indicated one of opposite surfaces of the second retainer means. Free ends of the arcuate extensions of the each spring portion elastically contact the above-indicated one surface of the second retainer means.

According to another aspect of the present invention, there is provided a dot-matrix print head comprising: a plurality of print wires;

a plurality of drive units for driving the plurality of print wires, respectively, each of the plurality of drive units including (a) an armature having a distal end to which the corresponding print wire is secured such that the print wire is substantially perpendicular to the armature, (b) an electromagnet disposed opposite to an intermediate portion of the armature, to magnetically attract the armature, (c) a compression coil spring baising the armature in a direction opposite to a direction of magnetic attraction of the electromagnetic, and (d) a support member having a hole in which the coil spring is accommodated, the plurality of drive units being spaced part from each other along a circle such that the distal ends of the armatures are disposed in a central part of the circle and the armatures extend radially of the circle from the distal ends toward proximal ends thereof; and support means for supporting the plurality of print wires such that free ends of the print wires are positioned in at least one row on a straight line. The coil springs of the plurality of drive units have the same free length and the same spring constant. Depths of the holes accommodating the coil springs are determined so that the depths increase with an amount of deflection of the corresponding print wire between a fixed end thereof connected to the distal end of the corresponding armature and the free end thereof, whereby a sum of a biasing force which is developed due to the deflection of the corresponding print wire and which is applied to the corresponding armature, and a biasing force of the corresponding coil spring, is substantially the same for all of the drive units. In this arrangement, all print wires are impacted against a recording medium with substantially the same printing pressure.

BRIEF DESCRIPTION OF THE DRAWINGS

The foregoing and other objects, features and advantages of the present invention will become more apparent by reading the following preferred embodiment of the invention, when considered in connection with the accompanying drawings, in which.

DETAILED DESCRIPTION OF THE PREFERRED EMBODIMENT

Figure 1:
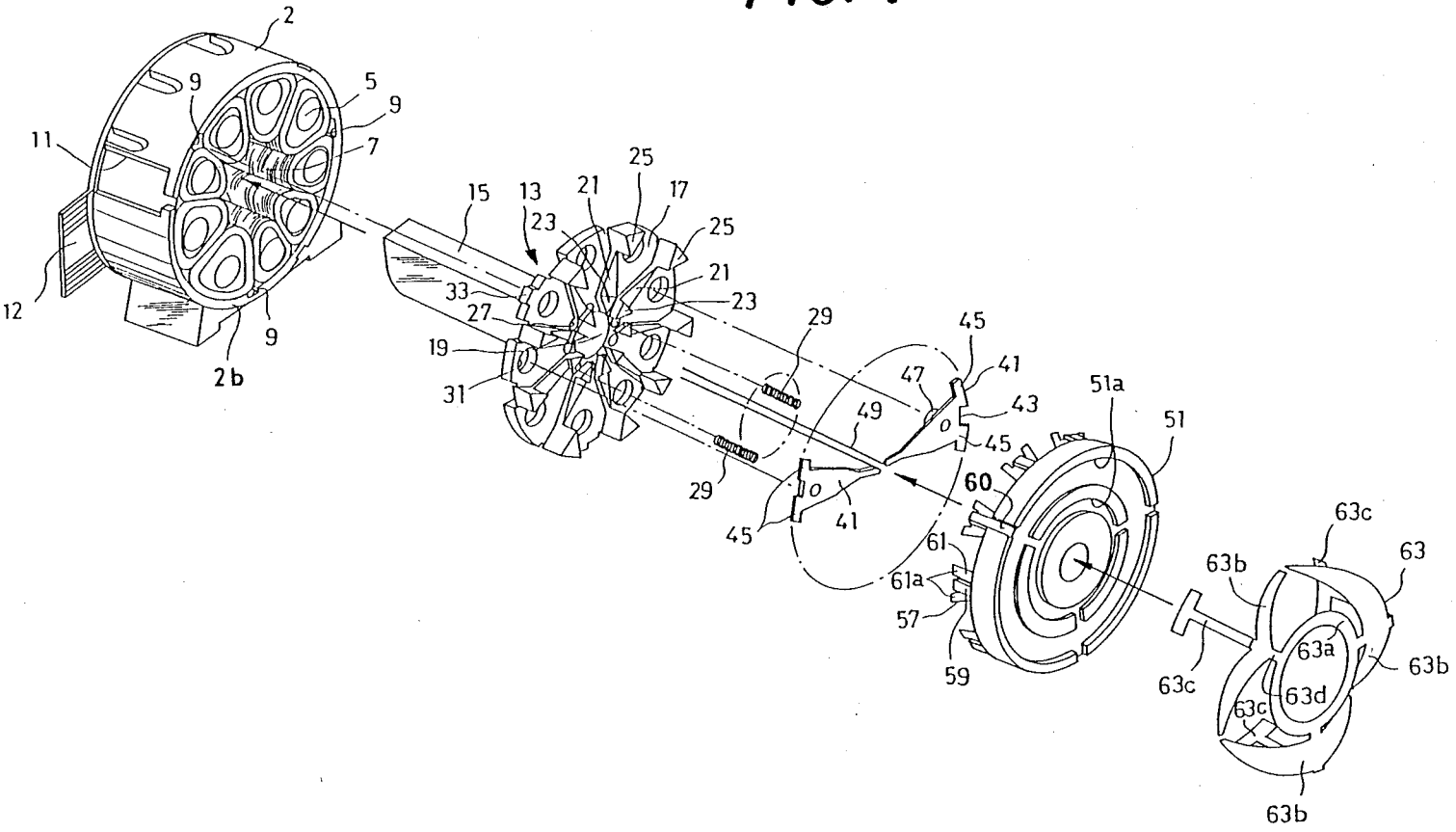
FIG. 1 is an exploded view in perspective of one embodiment of a dot-matrix print head of the present invention.
Figure 2:
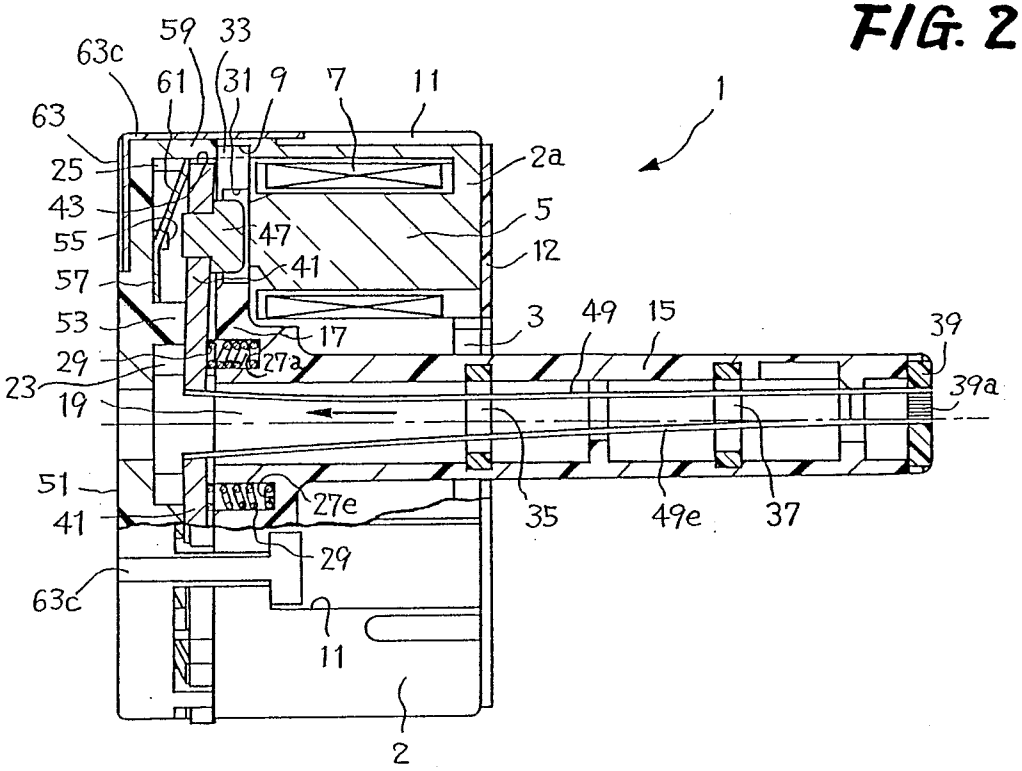
FIG. 2 is a side elevational view partly in cross section of the print head of FIG. 1.
Figure 3:
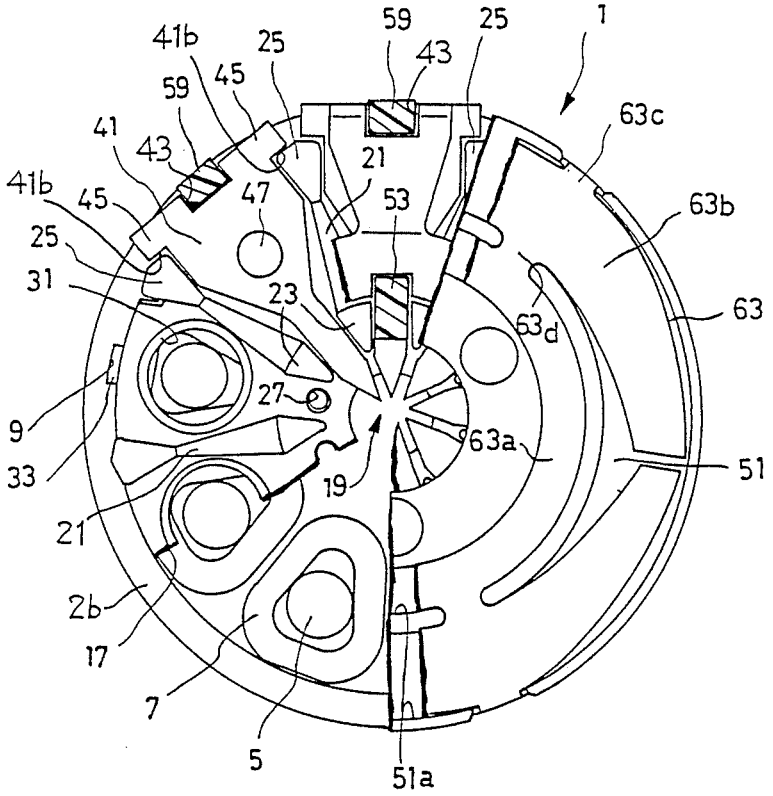
FIG. 3 is a rear elevational view of the print head, with a rear retainer member partly cut away to show the interior construction of the print head.

Referring first to FIGS. 1, 2 and 3, there is shown the preferred embodiment of a dot-matrix print head generally indicated at 1. The print head 1 has a cylindrical yoke 2 made of a suitable material having a high magnetic flux density, such as a Co-Fe alloy, e.g., Permendur. The cylindrical yoke 2 has a front or bottom wall 2*a* (FIG. 2) at one of its opposite longitudinal ends, namely, at its front end. The front wall 2a has a central opening 3 through which a hollow nose 15 (which will be described) extends, as indicated in FIG. 2. The cylindrical yoke 2 accommodates nine iron cores 5 such that the iron core 5 are integral with each other and with the front wall 2a. The iron cores 5 are spaced apart from each other in a circumferential direction of the yoke 2. A coil 7 is wound on each of the iron cores 5. The coils 7 cooperate with the iron cores 5 to constitute nine electromagnets for activating nine armatures 41 (which will be described). In a radially inner part of a rear end face 2b of the cylindrical wall of the yoke 2, there are formed three recesses 9 which are evenly spaced from each other in the circumferential direction of the cylindrical wall. These three recesses 9 are provided to accommodate respective three tabs 33 formed on the periphery of a generally disc-like support plate 17. The cylindrical yoke 2 and the disc-like support plate 17 are positioned relative to each other through engagement of the tabs 33 with the recesses 9. In the outer circumferential surface of the cylindrical wall of the yoke 2, there are formed three grooves 11 which are evenly spaced from each other in the circumferential direction of the yoke 2. These grooves 11 are provided to receive respective three fixing legs 63c of an elastic fastener 63 (which will be described). Leads of the coils 7 are soldered to conductors of a flexible cable 12 which is attached to the front wall 2a. The conductors of the flexible cable 12 are electrically connected to a printhead drive unit (not shown) of a dot-matrix printer, so that the coils 7 are selectively energized according to printing data, to activate the armatures 41 for moving corresponding print wires 49 from their inoperative position to their operated position, for printing images such as characters in a matrix of dots in a well known manner.

The hollow nose 15 and the generally disc-like support plate 17 are provided in the form of a unitary or integral first retainer member 13 molded of a synthetic resin. This first retainer member 13 is secured to the cylindrical yoke 2 such that the disc-like support plate 17 is accommodated within the cylindrical wall of the yoke 2 and the hollow nose 15 extends through the central opening 3, as indicated in FIG. 2. The disc-like support plate 17 (hereinafter referred to as "support plate 17") has a central opening 19 which communicates with the hollow nose 15. The outside diameter of the support plate 17 is determined so that the outer periphery of the support plate 17 engages the inner circumferential surface of the cylindrical yoke 2, as indicated in FIG. 3.

On one of opposite surfaces of the support plate 17 remote from the hollow nose 15, there are formed nine elongate support walls 21 integral with the support plate 17. These support walls 21 are disposed so as to extend in the radial direction of the disc-like support plate 17, from the central opening 19 toward the outer circumference. The nine support walls 21 are evenly spaced from each other in the circumferential direction of the support plate 17.

Figure 4:
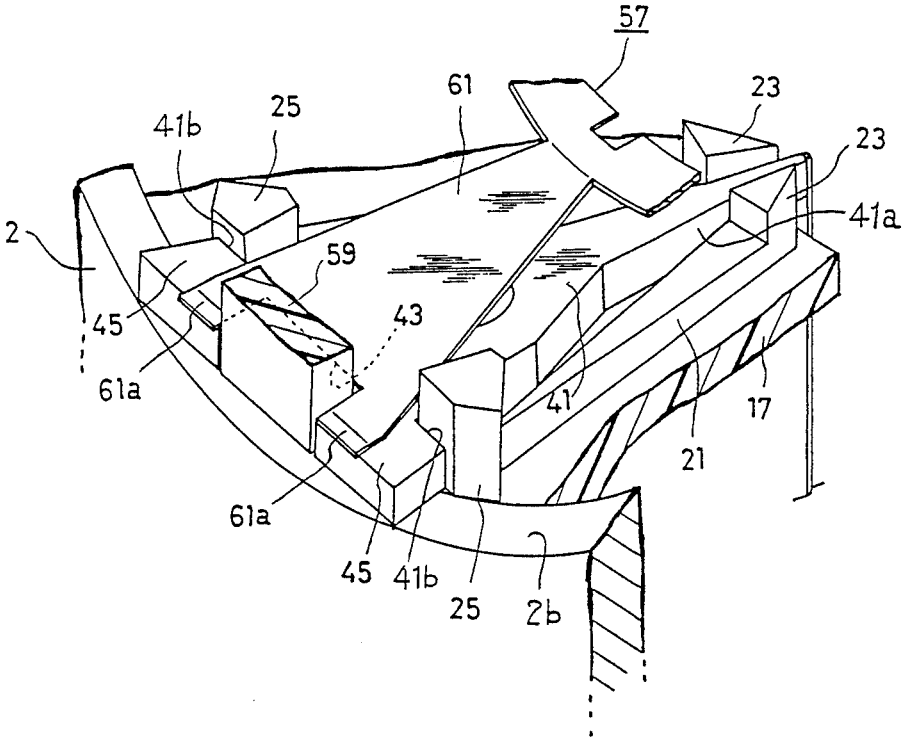
FIG. 4 is a fragmentary perspective view, showing a structure for pivotally supporting an armature at its proximal end.

Each of the previously indicated nine armatures 41 is disposed between the two adjacent support walls 21, such that the distal end of the armature 41 to which the print wire 49 is secured is located within the central opening 19, as most clearly shown in FIG. 2, while the proximal end is positioned on the end face 2b of the cylindrical yoke 2, as most clearly indicated in FIG. 4. The two adjacent support walls 21 are disposed on opposite sides of the corresponding armature 41. Each support wall 21 has an inner support portion 23 at its inner end adjacent to the central opening 19, and an outer support portion 25 at its outer end adjacent to the periphery of the support plate 17. The adjacent two inner support portions 23 are located near the distal end of the corresponding armature 41, and slidably engage generally longitudinal opposite surfaces 41a of the armature 41. The armature 41 has a pair of lateral extensions 45 at its proximal end. These lateral extensions 45 extend in opposite directions perpendicular to the longitudinal direction of the armature 41. The outer support portions 25 of the adjacent two support walls 21 are located near the proximal end of the corresponding armature 41, and slidably engage a corresponding pair of lateral surfaces 41b of the lateral extensions 45.

The support plate 17 has nine spring holes 27 (27a through 27i) each formed between the inner support portions 23 of the corresponding pair of the support walls 21. In FIG. 2, only the holes 27a and 27e are shown. These spring holes 27a–27i accommodate respective compression coil springs 29 such that one end of each spring 29 bears on the bottom surface of the corresponding hole 27, while the other end bears on a part of the corresponding armature 41 adjacent to its distal end. These coil springs 29 hold the armatures 41 in their inoperative positions in which their distal ends are spaced a predetermined distance away from the disc-like support plate 17, whereby the print wires 49 are held in their non-operated positions of FIG. 2. The nine coil springs 29 have the same free length and the same spring constant, but the spring holes 27a–27i have different depths for the reason which will be described.

The support plate 17 has nine through-holes 31 each formed between the adjacent support walls 21. the through-holes 31 are aligned with the iron cores 5, and accommodate movable pieces 47 fixed to the respective armatures 41. With the support plate 17 positioned in the cylindrical yoke 2 with the previously indicated tabs 33 engaging the previously indicated recesses 9, the ends of the movable pieces 47 are positioned opposite to the ends of the respective iron cores 5.

Figure 5:
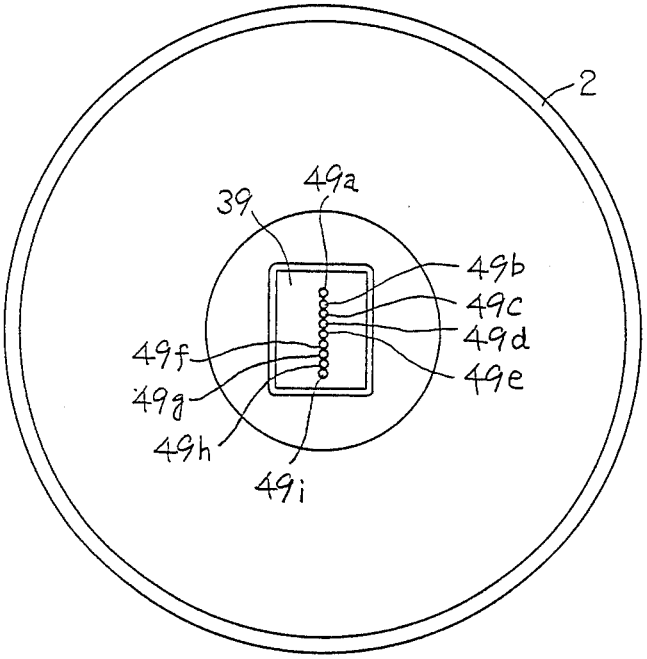
FIG. 5 is a front elevational view of the print head.

As indicated in FIGS. 1 and 2, the nine print wires 49a–49i are fixed, by brazing or other suitable method, to the distal ends of the corresponding armatures 41, such that the wires 49a–49i (only 49a and 49e indicated in FIG. 2) are substantially perpendicular to the planes of the armatures 41. The hollow nose 15 has three guide members 35, 37 and 39, which are spaced apart from each other in the longitudinal direction of the nose 15. The print wires 49a–49i whose fixed ends are arranged on a circle are gradually elastically deformed as they pass through the hollow nose 15 while being guided and supported by the first and second guide members 35, 37, so that their free ends supported in holes 39a in the third guide member 39 are arranged in a single row on a vertical straight line, as indicated in FIG. 5.

In the above-described arrangement of the print wires 49a–49i within the hollow nose 15, the print wires 49a–49i have different amounts of elastic deformation or deflection between their fixed and free ends. In the present embodiment, the first print wire 49a has the least amount of deflection, and the fifth print wire 49e has the largest amount of deflection. The amounts of deflection of the second, third and fourth print wires 49b–49d increase in steps in this order, and those of the sixth through eighth print wires 49f–49h decrease in steps in this order. The print wires 49h and 49i have the same amounts of deflection since they have the same radial distance between the fixed and free ends. While the coil springs 29 serve to hold the armatures 41 in their non-operated position, the print wires 49a–49i function more or less to apply biasing forces to the armatures 41, due to their elastic deflection within the hollow nose 15. However, the biasing forces of the print wires 49a–(49h) which are produced due to their deflection and which are applied to the respective armatures 41 are different from each other, because the amounts of deflection of the print wires 49a–49h are different. Therefore, the armatures 41 receive different total values of biasing forces. Namely, the sum of the biasing force produced by the coil spring 29 and the biasing force produced by the print wire 49 is different from one armature 41 to another. To compensate for this difference, the individual compression coil springs 29 are given different values of biasing force, by changing the depths of the corresponding spring holes 27a–27i. In this specific example, the depths of the spring holes 27a, 27b, 27c, 27d, 27e, 27f, 27g, 27h and 27i are 2.10 mm, 2.30 mm, 2.50 mm, 2.56 mm, 2.75 mm, 2.70 mm, 2.60 mm, 2.25 mm, and 2.25 mm, respectively. That is, the depths of the spring holes 27a–27i increase with an amount of deflection of the corresponding print wire 49 within the hollow nose 15.

The armatures 41 are made of Permendur or other suitable material similar to that of the yoke 2, which has a high magnetic flux density. The proximal end of each armature 41 has a cutout 43 formed in the end surface so as to extend toward the distal end, such that the cutout 43 is positioned between the two lateral extensions 45. As most clearly indicated in FIG. 4, the cutouts 43 are adapted to receive corresponding nine support protrusions 59 formed on one of opposite surfaces of a second retainer member 51 which will be described. This support protrusion 59 cooperates with the previously described pair of outer support portions 25, 25 of the support walls 21, in order to support the corresponding armature 41 so that the armature 41 is pivotable about its proximal end, in a plane perpendicular to the plane of the armature 41. In this condition, the armature 41 normally held in its non-operated position is pivoted about its proximal end to its operated position, upon energization of the coil 7 of the corresponding electromagnet, with the movable piece 47 magnetically attracted to the corresponding iron core 5.

The second retainer member 51, which cooperates with the first retainer member 13 to constitute support means for supporting the armatures 41 and the print wires 49, is molded of a synthetic resin material. On the surface of the second retainer member 51 from which the previously described support protrusions 59 extend, there are formed nine stopper portions 53 opposite to intermediate portions of the armatures 41 between its distal and proximal ends. The armatures 41 biased by the coil springs 27 are held in abutting contact with the corresponding stopper portions 53, while the coils 7 are not energized. Thus, the stopper portions 53 determine the inoperative or non-operated positions of the armatures 41.

On the surface of the second retainer member 51 on which the stopper portions 53 are formed, there are also formed fixing bosses 55 which are located radially inward with respect to the stopper portions 53 and are spaced from each other circumferentially on the second retainer member 51. The fixing bosses 55 retain a biasing member 57 at the outer periphery of its central annular portion. The biasing member 57 has nine sheet spring portions 61 which extend radially of the second retainer member 51, from the central annular portion toward the proximal ends of the armatures 41. The free end of each sheet spring portion 61 has a pair of spaced-apart arm portions 61a which sandwich the support protrusion 59 and which are held in pressed contact with the lateral extensions 45 of the armature 41. The proximal end of the armature 41 is thus held pressed against the end face 2b of the cylindrical yoke 2, so that the axis of pivot of the armature 41 is located at the outer edge of the lateral extensions 45 at the proximal end. As previously described, the support protrusions 59 engage the cutouts 43 formed in the proximal ends of the armatures 41.

In the surface of the second retainer member 51 opposite to the surface on which the stopper portions 53 are formed, there are formed an inner and an outer annular groove 51a, 51a. The inner annular groove 51a receives a central annular portion 63a of an elastic fastener 63, while the outer annular groove 51a receives three spring portions 63b of the elastic fastener 63.

The elastic fastener 63 has three radial arms 63d which extend radially from the central annular portion 63a and which terminate in the respective spring portions 63b. Each spring portion 63b includes a sheet spring which comprises a pair of arcuate extensions (63b) which extend from the corresponding radial arm 63d in opposite directions, so as to be fitted in the outer annular groove 51a in the second retainer groove 51a. The arcuate extensions are formed so that they approach the surface of the second retainer member 51 as they extend from the end of the radial arm 63d. The elastic fastener 63 further has three fixing legs 63c which extend from the sheet spring portion 63d, so as to pass through corresponding grooves 60 in the second retainer member 51 and to engage the previously indicated grooves 11 formed in the cylindrical yoke 2. The elastic fastener 63 is molded such that the individual parts 63a, 63b, 63c and 63d are integral with each other. As indicated above, the second retainer member 51 is fastened to the cylindrical yoke 2 by the elastic fastener 63, such that the fixing legs 63c are locked in the grooves 11, while the annular portion 63a is accommodated in the inner annular groove 51a. In this condition, the free ends of the arcuate extensions 63b are held in pressed contact with the bottom surface of the outer annular groove 51a.

The dot-matrix print head 1 constructed as described hitherto is assembled in the following manner.

Initially, the compression coil springs 29 are placed in the spring holes 27a–27i in the disc-like support plate 17. Then, each armature 41 is positioned between the corresponding pair of support walls 21, such that the lateral surfaces 41b of the lateral extensions 45 engage the outer support portions 25 of the support walls 21, and such that the movable pieces 47 are accommodated in the through-holes 31. With the armatures 41 positioned relative to the support plate 17 as described above, the print wires 49a–49i extend through the hollow nose 15 while being guided by the first and second guide members 35, 37. In this condition, the free ends of the print wires 49a–49i are arranged in a single straight row as indicated in Fig. 5, while being supported in the holes 39a in the third guide member 39 at the free end of the hollow nose 15.

The first retainer member 13, with the armatures 41 set on the support plate 17 and with the print wires 49 extending through the hollow nose 15, is then positioned relative to the cylindrical yoke 2 with the three tabs 33 engaging the recesses 9 formed in the end face 2b of the cylindrical yoke 2. In this condition, the hollow nose 15 extends through the central opening 3 in the cylindrical yoke 2, while the movable pieces 47 of the armatures 41 accommodated in the through-holes 31 are positioned opposite to the ends of the corresponding iron cores 5.

Successively, the second retainer member 51 is positioned relative to the assembly of the cylindrical yoke 2 and the first retainer member 13, such that the support protrusions 59 are fitted in the corresponding cutouts 43 formed in the proximal ends of the armatures 41. The support protrusions 59 cooperate with the outer support portions 25 of the support walls 21 on the support plate 17 to slidably pivotally support the armatures 41. Further, the proximal end of each armature 41 is held pressed against the end face 2b of the cylindrical yoke 2 by the corresponding sheet spring portion 61 of the biasing member 57 fixed to the second retainer member 51. The distal end portion of the armature 41 disposed between the inner support portions 23 is held in abutting contact with the stopper portion 53, under a biasing action of the corresponding coil spring 29. Thus, the corresponding print wire 49 is held in its non-operated position of FIG. 2.

Subsequently, the second retainer member 51 is fastened to the cylindrical yoke 2 by the elastic fastener 63, with the fixing legs 63c passing through the grooves 60 in the second retainer member 51, engaging the grooves 11 in the yoke 2. In this condition, the second retainer member 51 is pressed by the sheet spring portions 63b engaging the outer annular groove 51a. As a result, the support protrusions 59 engaging the cutouts 43 of the armatures are held in pressed contact with the end face 2b of the cylindrical yoke 2, and the radially inner portion of the second retainer member 51 is held abutted on the inner support portions 23 of the support walls 21 on the support plate 17. In this way, a suitable operating stroke of the armatures 41 at their distal ends is established.

Figure 6:
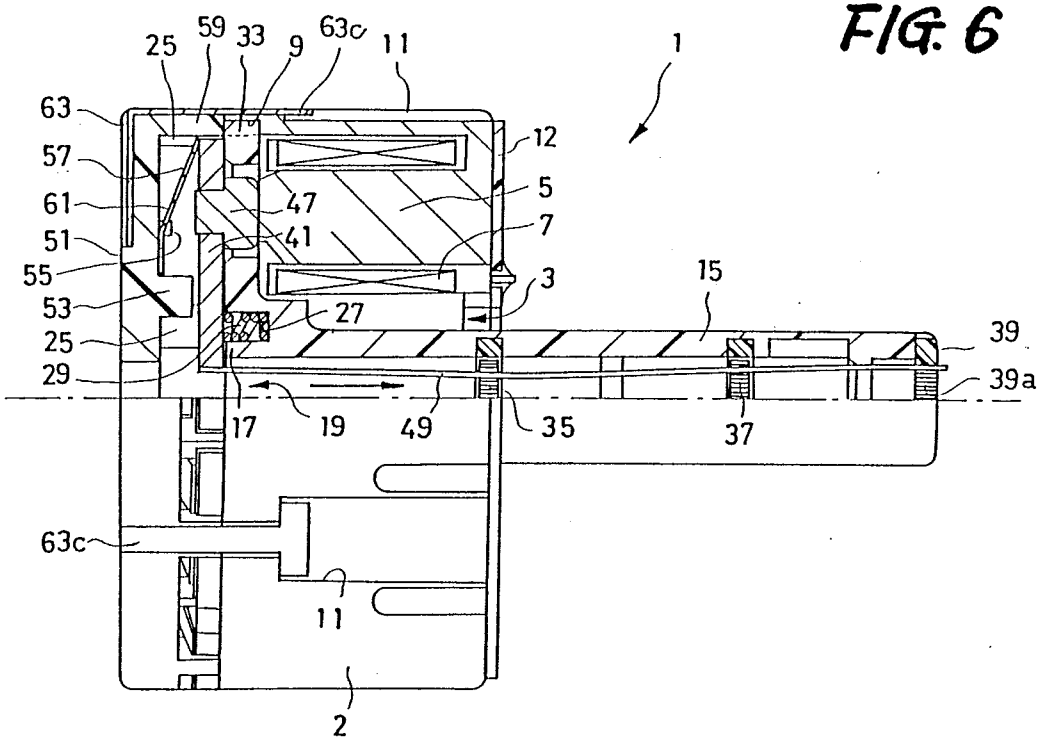
FIG. 6 is a side elevational view similar to FIG. 2, showing a print wire in its operated position.

Referring to FIGS. 2, 4 and 6, the operation of the instant dot-matrix print head 1 will be described.

Normally, the armature 41 is held in its non-operated position of FIG. 2 wherein the armature 41 is pivotable, upon energization of the corresponding coil 7, while being supported by the pivotal support structure at the proximal end, which comprises the outer support portions 25 of the support walls 21 engaging the lateral surfaces of the lateral extensions 45, and the support protrusion 59 engaging the cutout 43, as shown in FIG. 4. In this non-operated condition, the proximal end of the armature 41 is held pressed against the end face 2b of the yoke 2 by the sheet spring portion 61 of biasing member 57, while the distal end of the armature 41 is held pressed against the stopper portion 53 by the coil spring 29. As previously described, the biasing forces of the individual coil springs 29 are adjusted by changing the depths of the corresponding spring holes 27a–27i, depending upon the amounts of deflection of the corresponding print wires 49a–49i, so that all armatures 41 are held in their non-operated position by the same total biasing force (biasing force of the spring 29 and biasing force due to deflection of the corresponding print wire 49). In the non-operated position, the armatures 41 are biased in the direction indicated by arrow A in FIG. 2.

Upon energization of the coil 7 with a current applied thereto from the print-head driver circuit through the flexible cable 12 according to printing data, a magnetix flux path is formed by the iron core 5, yoke 2, armature 41 and its movable piece 47. As a result, the movable piece 47 of the armature 41 is magnetically attracted to the iron core 5, whereby the armature 41 is pivoted against the biasing force of the coil spring 29, about an axis which passes the arm portions 61a of the sheet spring portion 61 acting on the lateral extensions 45, in the direction indicated by arrow B in FIG. 6. Consequently, the armature 41 is moved to its operated position of FIG. 6, and the corresponding print wire 49 is moved to its printing position. When the armature 41 is pivoted, the distal end portion is slidably guided by the inner support portions 23 of the support walls 21 engaging the opposite surfaces 41a of the armature 41. Since the proximal end of the armature 41 is held pressed onto the end face 2b by the sheet spring portion 61, the reactance of the magnetic flux path formed by the iron core 5, yoke 2, armature 41 and movable piece 47 is maintained at a relatively low leverl, whereby the operating response of the armature 41 to the energization of the coil 7 is improved. Further, the outer support portions 25 engaging the lateral extensions 45 and the support protrusion 59 engaging the cutout 43 prevent the armature 41 from being displaced in the longitudinal direction upon pivotal movement thereof.

Since the armatures 41 are held in their non-operated positions with the same biasing force or pre-tension in the direction of arrow A in FIG. 2, as previously described, all print wires 49 are operated with the same printing pressure against a recording medium. Although the spring holes 27 are formed with different depths to provide differences in the biasing forces of the coil springs 29 to compensate for differences in the biasing forces of the print wires 49 due to their deflection within the hollow noes 15, it is possible that the coil springs 29 have different free lengths or different spring constants for assuring consistent printing pressure of the individual print wires 49. Alternatively, the same purpose may be attained by changing the height of the stopper portions 53, or the angle of fixation of the print wires relative to the armatures 41.

As previously described, the sheet spring portions 63b of the elastic fastener 63 are held in pressed contact with the radially outer portion of the second retainer member 51. Therefore, the central portion of the retainer member 51 in which the stopper portions 53 are formed is protected against elastic deformation by the biasing force of the elastic fastener 63. This arrangement contributes to preventing a variation in the position of the stopper protions 53 in the direction perpendicular to the plane of the armatures 41. Therefore, the operating strokes of the print wires 49a–49i are made equal to each other. Further, the radially outer portion of the second retainer member 51 has a uniform degree of elastic deformation if caused by the sheet spring portions 63c of the elastic fastener 63, since the spring portions 63c are equally spaced from each other in the circumferential direction of the retainer member 51.

In the illustrated embodiment, each armature 41 is pivotally supported at three points by a pair of first support protrusions in the form of the outer support portions 25 engaging the lateral surfaces 41b of the lateral extensions 45, and a second support protrusion 59 engaging the cutout 43. In this pivotal support structure, the distance between the proximal end surface of the armature 41 and the innermost point of frictional contact of the armature 41 with the support structure is made smaller than the corresponding distance in the conventional support structure which uses a support pin engaging a hole formed in the armature. Therefore, the amount of pivotal movement of the armature 41 at the point of pivotal support is held relatively small, whereby the friction between the support protrusions 25, 59 and the armature 41 is minimized. This means a reduced displacement of the armature 41 in its longitudinal direction, and reduced variations in the operating stroke and printing pressure of the print wires 49.

While the present invention has been described in its preferred embodiment with a certain degree of particularity, it is to be understood that the invention is by no means confined to the precise disclosure contained herein, but may be embodied with various changes, modifications and improvements which may occur to those skilled in the art, without departing from the scope of the invention defined in the appended claims.

What is claimed is:

1. A dot-matrix print head comprising:

a plurality of print wires;

a plurality of armatures corresponding to said plurality of print wires and disposed substantially perpendicularly to said print wires, each of said plurality of armatures having a distal end connected to a corresponding print wire, and a proximal end opposite to said distal end in a longitudinal direction thereof, said each armature having a pair of lateral extensions which extend in lateral opposite directions from said proximal end;

a cylindrical yoke having a bottom wall at one of opposite longitudinal ends thereof, said bottom wall having a first central opening through which said print wires are passed, said proximal end of said armature being supported on an end face of said cylindrical yoke at the other longitudinal end remote from said bottom wall;

drive means for driving said plurality of armatures, said drive means including a plurality of electromagnets corresponding to said plurality of armatures, said electromagnets being energized and deenergized to pivot said armatures about said proximal ends in opposite directions to thereby give the corresponding print wires longitudinal movements for dot-matrix printing, said electromagnets including iron cores accommodated in said cylindrical yoke such tht the iron cores are supported by said bottom wall in spaced-apart relation with each other in a circumferential direction of said yoke; and support means for supporting said plurality of armatures and said plurality of print wires such that said armatures are pivotable at the proximal ends thereof while said print wires are longitudinally movable, said support means including first retainer means and second retainer means which cooperate with each other to sandwich said plurality of armatures such that said second retainer means is fixed to said cylindrical yoke, said first retainer means including a generally disc-like portion which is entirely accommodated within said cylindrical yoke and which has a second central opening aligned with said first central opening of said cylindrical yoke so as to permit said print wires to extend therethrough, said plurality of armatures bing disposed on said generally disc-like portion such that said armatures extend radially from said second central opening;

said support means including a pair of first support protrusions engaging a pair of lateral surfaces of said pair of lateral extensions of said each armature, said lateral surfaces facing in said longitudinal direction toward said distal end, said support means further including a second support protrusion which is disposed between said pair of first support protrusions as seen in the lateral direction of said each armature, said second support protrusion engaging an end surface of said proximal end of said each armature, said pair of first support protrusions and said second support protrusion permitting said each armature to be pivoted about said proximal end while preventing said each armature from being moved in said longitudinal direction;

said second retainer means further including a biasing member which acts on portions of said plurality of armatures adjacent to said proximal ends, so as to hold said proximal end of said each armature in pressed contact with said end face of said cylindrical yoke.

2. A dot-matrix print head according to claim 1, wherein said proximal end of said each armature has a cutout formed in said end surface toward said distal end, said second support protrusion of said support means being fitted in said cutout.

3. A dot-matrix print head according to claim 1, wherein said pairs of first support protrusions are disposed in spaced-apart relation with each other along an outer circumferential part of said generally disc-like portion, said second retainer means having said second support protrusion for each of said plural pairs of the first support protrusions.

4. A dot-matrix print head according to claim 1, wherein said generally disc-like portion of said first retainer means has plural pairs of third support protrusions corresponding to said plurality of armatures, each of said third support protrusions engaging a pair of generally longitudinal surfaces of one of said armatures adjacent to said distal end, so as to prevent said distal end of said one armature from moving in said lateral direction while permitting said one armature to be pivoted at said proximal end on said end face of said cylindrical yoke.

5. A dot-matrix print head according to claim 1, wherein said support means comprises a plurality of springs corresponding to said plurality of armatures, each of said springs being disposed between a part of one of said armatures adjacent to said distal end, and a part of said generally disc-like portion of said first retainer means opposite to said part of said one armature, said each spring holding said one armature in an inoperative position thereof in which said distal end is spaced a predetermined distance away from said part of said generally disc-like portion, biasing forces of said springs being determined so that a sum of the biasing force of said each spring, and a biasing force of the corresponding print wire which is developed due to elastic deformation thereof and which is applied to a corresponding armature, is substantially the same for all of said plurality of armatures.

6. A dot-matrix print head according to claim 5, wherein said springs are compression coil springs which have the same free length and the same spring constant, said coil springs being accommodated in respective holes formed in said part of said generally disc-like portion of said first retainer means such that one end of each said spring bears on a bottom surface of its corresponding hole, said respective holes having different depths to thereby give said coil springs different values of biasing force.

7. A dot-matrix print head according to claim 1, wherein said first retainer means further includes a hollow nose portion which extends perpendicularly from one of opposite surfaces of said generally disc-like portion, said hollow nose portion communicating with said second central opening in said generally disc-like portion, and passing through said first central opening in said bottom wall of said cylindrical yoke, said plurality of print wires being longitudinally slidably guided in said hollow nose portion.

8. A dot-matrix print head comprising:

a plurality of print wires;

a plurality of armatures corresponding to said plurality of print wires and disposed substantially perpendicularly to said print wires, each of said plurality of armatures having a distal end connected to a corresponding print wire, and a proximal end opposite to said distal end in a longitudinal direction thereof, said each armature having a pair of lateral extensions which extend in lateral opposite directions from said proximal end;

a cylindrical yoke having a bottom wall at one of opposite longitudinal ends thereof, said bottom wall having a first central opening through which said print wires are passed;

drive means for driving said plurality of armatures, said drive means including a plurality of electromagnets corresponding to said plurality of armatures, said electromagnets being energized and deenergized to pivot said armatures about said proximal ends in opposite directions to thereby give corresponding print wires longitudinal movements for dot-matrix printing, said electromagnets including iron cores accomodated in said cylindrical yoke such that the iron cores are supported by said bottom wall in spaced-apart relation with each other in a circumferential direction of said yoke;

support means for supporting said plurality of armatures and said plurality of print wires such that said armatures are pivotable at the proximal ends thereof while said print wires are longitudinally movable, said support means including first retainer means and second retainer means which cooperate with each other to sandwich said plurality of armatures such that said second retainer means is fixed to said cylindrical yoke, said first retainer means including a generally disc-like portion which has a second central opening aligned with said first central opening of said cylindrical yoke so as to permit said print wires to extend therethrough, said plurality of armatures being disposed on said generally disc-like portion such that said armatures extend radially from said second central opening;

said support means including a pair of first support protrusions engaging a pair of lateral surfaces of said pair of lateral extensions of said each armature, said lateral surfaces facing in said longitudinal direction toward said distal end, said support means further including a second support protrusion which is disposed between said pair of first support protrusions as seen in the lateral direction of said each armature, said second support protrusion engaging an end surface of said proximal end of said each armature, said pair of first support protrusions and said second support protrusion permitting said each armature to be privoted about said proximal end while preventing said each armature from being moved in said longitudinal direction; and elastic fastening means for fastening said second retainer means to said cylindrical yoke, said elastic fastening means including a plurality of fixing legs engaging a plurality of first grooves and a plurality of second grooves, said first grooves being formed in an outer circumferential surface of said cylindrical yoke such that said first grooves are spaced from each other circumferentially of the cylindrical yoke and are parallel to a centerline of said cylindrical yoke, said second grooves being formed in an outer circumferential surface of said second retainer means such that said second grooves are aligned with said first grooves, respectively, said elastic fastening means further including a plurality of spring portions which are held in elastically pressed contact with one of opposite surfaces of said second retainer means remote from said first retainer means, whereby said second retainer means is held pressed against an end face of said cylindrical yoke.

9. A dot-matrix print head according to claim 8, wherein said elastic fastening means further includes a central portion, and a plurality of radial arms which extend radially from said central portion and terminate in proximal ends of the corresponding fixing legs, each of said spring portions consisting of a sheet spring which comprises a pair of arcuate extensions which extend from the corresponding radial arm in opposite directions along a circumference of said second retainer means such that said arcuate extensions approach said one of opposite surfaces of said second retainer means, free ends of said arcuate extensions of said each spring portion elastically contacting said one of opposite surfaces of said second retainer means.

10. A dot-matrix print head comprising:

a plurality of print wires;

a plurality of armatures corresponding to said plurality of print wires and disposd substantially perpendicularly to said print wires, each of said plurality of armatures having a distal end connected to a corresponding print wire, and a proximal end opposite to said distal end in a longitudinal direction thereof;

a cylindrical yoke having a bottom wall at one of opposite longitudinal ends thereof, said bottom wall having a first central opening through which said print wires are passed;

drive means including a plurality of iron cores corresponding to said plurality of armatures, for pivoting said each armature about said proximal end thereof to therby give corresponding print wires longitudinal movements for dot-matrix printing, said iron cores being accommodated within said cylindrical yoke such that said iron cores are supported by said bottom wall in spaced-apart relation with each other in a circumferential direction of said yoke;

first retainer means inlcuidng a generally disc-like portion, for supporting said plurality of armatures, said generally disc-like portion being entirely accommodated within said cylindrical yoke and having a second central opening aligned with said first central opening of said cylindrical yoke so as to permit said print wires to extend therethrough, said plurality of armatures being disposed on said generally disc-like portion such that said armatures extend radially from said second central opening;

second retainer means disposed so as to cooperate with said first retainer means to sandwich said plurality of armatures, said second retainer means including a biasing member which acts on portions of said plurality of armatures adjacent to said proximal ends thereof, to hold the proximal end of said each armature in pressed contact with an end face of said cylindrical yoke at the other longitudinal end remote from said bottom wall; and elastic fastening means for fastening said second retainer means to said cylindrical yoke, said elastic fastening means including a plurality of fixing legs engaging a plurality of first grooves, said first grooves being formed in an outer circumferential surface of said cylindrical yoke such that said first grooves are spaced from each other circumferentially of the cylindrical yoke and are parallel to a centerline of said cylindrical yoke, said elastic fastening means further including a plurality of spring portions which are held in elastically pressed contact with one of opposite surfaces of said second retainer means remote from said first retainer means, whereby said second retainer means is held pressed against an end face of said cylindrical yoke.

11. A dot-matrix print head according to claim 15, wherein said elastic fastening means further includes a central portion, and a plurality of radial arms which extend radially from said central portion and terminate in proximal ends of corresponding fixing legs, each of said spring portions consisting of a sheet spring which comprises a pair of arcuate extensions which extend from a corresponding radial arm in opposite directions along a circumference of said second retainer means such that said arcuate extensions approach said one of opposite surfaces of said second retainer means, free ends of said arcuate extensions of said each spring portion elastically contacting said one of opposite surfaces of said second retainer means.

12. A dot-matrix print head comprising:

a plurality of print wires.

a plurality of armatures corresponding to said plurality of print wires and disposed substantially perpendicularly to said print wires, each of said plurality of armatures having a distal end connected to a corresponding print wire, and a proximal end opposite to said distal end in a longitudinal direction thereof;

a cylindrical yoke having a bottom wall at one of opposite longitudinal ends thereof, said bottom wall having a first central opening;

drive means including a plurality of iron cores corresponding to said plurality of armatures, for pivoting said each armature about said proximal end thereof to thereby give corresponding print wires longitudinal movements for dot-matrix printing, said iron cores being accommodated within said cylindrical yoke such that said iron cores are supported by said bottom wall in spaced-apart relation with each other in a circumferential direction of said yoke;

first retainer means including a generally disc-like portion, said generally disc-like portion being entirely accommodated within said cylindrical yoke and having a second central opening aligned with said first central opening of said cylindrical yoke so as to permit said print wires to extend therethrough, said plurality of armatures being disposed on said generally disc-like portion such that said armatures extend radially from said second central opening;

second retainer means disposed so as to cooperate with said first retainer means to sandwich said plurality of armatures, said second retainer means being fixed to said cylindrical yoke, said first retainer means further including a hollow nose portion which extends perpendicularly from one of opposite surfaces of said generally disc-like portion, said hollow nose portion communicating with said second central opening in said generally disc-like portion and passing through said first central opening in said bottom wall of said yoke, said print wires being longitudinally slidably guided in said hollow nose portion; and a plurality of springs corresponding to said plurality of armatures, each of said springs being disposed between a part of said each armature adjacent to said distal end and a part of said generally disc-like portion of said first retainer means opposite to said part of said each armature, said each spring holding said each armature in an inoperative position thereof in which said distal end is spaced a predetermined distance away from said part of said generally disc-like portion, biasing forces of said springs being determined so that a sum of a biasing force of said each spring, and a biasing force of a corresponding print wire which is developed due to elastic deformation thereof and which is applied to a corresponding armature, is substantially the same for all of said plurality of armatures.

13. A dot-matrix print head according to claim 17, wherein said springs are compression coil springs which have the same free length and the same spring constant, said coil springs being accommodated in respective holes formed in said part of said generally disc-like portion of said first retainer means such that one end of each said spring bears on a bottom surface of its corresponding hole, said respective holes having different depths to thereby give said coil springs different values of biasing force.

14. A dot-matrix print head according to claim 17, wherein said second retainer means includes a biasing member which acts on portions of said plurality of armatures adjacent to said proximal ends thereof, to hold said each armature in pressed contact with an end face of said cylindrical yoke at the other longitudinal end remote from said bottom wall.

15. A dot-matrix print head comprising:

a plurality of print wires;

a plurality of armatures corresponding to said plurality of print wires and disposed substantially perpendicularly to said print wires, each of said plurality of armatures having a distal end connected to a corresponding print wire, and a proximal end opposite to said distal end in a longitudinal direction thereof;

a cylindrical yoke having a bottom wall at one of opposite longitudinal ends thereof, said bottom wall having a first central opening, said proximal end of said each armature being supported on an end face of said cylindrical yoke at the other longitudinal end remote from said bottom wall;

drive means including a plurality of iron cores corresponding to said plurality of armatures, for pivoting said each armature about said proximal end thereof to thereby give corresponding print wires longitudinal movements for dot-matrix printing, said iron cores being accommodated within said cylindrical yoke such that said iron cores are supported by said bottom wall in spaced-apart relation with each other in a circumferential direction of said yoke;

first retainer means for supporting said plurality of armatures, including a generally disc-like portion having a second central opening aligned with said first central opening of said cylindrical wall, and a hollow nose portion which communicates with said second central opening of said generally disc-like portion and which extends perpendicularly from one of opposite surfaces of said generally disc-like portion so as to pass through said first central opening in said bottom wall of said cylindrical yoke, for longitudinally slidably guiding said print wires therethrough;

said generally disc-like portion being entirely accommodated within said cylindrical yoke such that a periphery of said generally disc-like portion emerges an inner circumferential surface of said cylindrical yoke; and second retainer means disposed on one side of said generally disc-like portion remote from said hollow nose portion, and cooperating with said first retainer means to sandwich said plurality of armatures and position said armatures in a plane parallel to a direction of extension of said hollow nose portion, said second retainer means having a biasing member for holding said proximal end of each of said armatures in pressed contact with said end face of said cylindrical yoke.

* * * * *